US012630262B2

(12) United States Patent
Varga et al.

(10) Patent No.: US 12,630,262 B2
(45) Date of Patent: May 19, 2026

(54) INFLATABLE BOAT WITH A DROP STITCH BOTTOM FOR USE WITH A MOTOR

(71) Applicant: Kristofer George Varga, Surrey (CA)

(72) Inventors: Kristofer George Varga, Surrey (CA); Gregory Ernest Varga, Surrey (CA)

( * ) Notice: Subject to any disclaimer, the term of this patent is extended or adjusted under 35 U.S.C. 154(b) by 581 days.

(21) Appl. No.: 18/161,774

(22) Filed: Jan. 30, 2023

(65) Prior Publication Data

US 2024/0253741 A1 Aug. 1, 2024

(51) Int. Cl.
*B63B 7/08* (2020.01)
*B63B 1/28* (2006.01)

(52) U.S. Cl.
CPC ..... *B63B 7/087* (2013.01); *B63B 1/285* (2013.01); *B63B 7/082* (2013.01); *B63B 2231/52* (2013.01)

(58) Field of Classification Search
CPC ..... B63B 7/00; B63B 7/082; B63B 7/087; B63B 1/00; B63B 1/28; B63B 1/285; B63B 2231/52; B63C 9/00; B63C 9/04
USPC ..... 114/285
See application file for complete search history.

(56) References Cited

U.S. PATENT DOCUMENTS

| | | | | |
|---|---|---|---|---|
| 3,170,174 | A | 2/1965 | Hanel | |
| 6,095,077 | A * | 8/2000 | DeAgro | B63B 39/061 114/285 |
| 9,637,201 | B2 | 5/2017 | Hoge, Jr. | |
| 10,479,449 | B2 * | 11/2019 | Cooper | B63B 7/087 |
| 11,433,973 | B2 | 9/2022 | Losev et al. | |
| 2011/0303139 | A1 | 12/2011 | Hoge, Jr. | |
| 2017/0158288 | A1 | 6/2017 | Mccleod-Ross | |
| 2018/0178886 | A1 | 6/2018 | Kohnsen | |
| 2019/0263475 | A1 | 8/2019 | Cooper | |
| 2021/0214060 | A1 | 7/2021 | Mccaughan et al. | |

FOREIGN PATENT DOCUMENTS

| | | | |
|---|---|---|---|
| FR | 3125013 | A1 | 1/2023 |
| KR | 102057848 | B1 | 12/2019 |

* cited by examiner

*Primary Examiner* — Lars A Olson

(57) ABSTRACT

An inflatable boat for use with a motor having a jet intake or propeller, including: an inflatable body having a stern; a drop stitch inflatable bottom forming part of the inflatable body, the drop stitch inflatable bottom including one or more sections of high pressure drop stitch material and having a top side and bottom side; a cutout in the drop stitch inflatable bottom near the stern; and a cover covering the cutout and sealed to the top side of the drop stitch inflatable bottom; wherein the cutout and cover form a channel that facilitates a flow of water to the jet intake or propeller of the motor.

4 Claims, 6 Drawing Sheets

INFLATABLE BOAT WITH A DROP STITCH BOTTOM FOR USE WITH A MOTOR

FIELD OF THE INVENTION

This invention generally relates to a watercraft, and more particularly, to inflatable boats for use with a motor.

BACKGROUND OF THE INVENTION

Inflatable boats come in a variety of shapes, sizes and forms and can be powered in a variety of ways for a variety of purposes. For example, some come in the form of inflatable kayaks, designed to be powered by the manual paddling of a user and some come in the form of inflatable sport boats, designed to be powered by an outboard or inboard motor.

Examples of some prior art inflatable boats are described in U.S. Pat. No. 9,637,201 to Hoge and U.S. Pat. No. 11,433,973 to Losev et al. Hoge describes a drop stitch inflatable kayak propelled by the manual paddling of a user, whereas Losev describes an inflatable sport boat powered by an outboard motor.

Inflatable kayaks are inflatable boats having a small form factor designed to be propelled by the manual paddling of a user. Inflatable kayaks are desirable due to their lightweight construction, which results in ease in transportation and storage of the kayaks. However, conventional inflatable kayaks typically use rounded inflatable tubes to form portions of the hull, which reduces the speed and maneuverability of the inflatable kayak. Hoge presents a solution to this issue by providing inflatable kayaks with a drop stitch material to create an inflatable kayak with V-shaped sides to improve the speed and ease of propelling the kayak forward with manual paddling.

Inflatable sport boats powered by an outboard or inboard motor provide the benefits of being able to go further distances and at faster speeds with the added advantages of being lightweight, compactable, and portable. However, some of the known shortfalls of inflatable sport boats include stability issues at high speeds and difficulty navigating in shallow waters. To address some of these issues, Losev describes the addition of an inclined longitudinal tunnel having a wedge-shaped form in a vertical section on the side of the bottom of the boat contacting the water, which directs and improves water supply to an outboard engine, thereby improving operations in shallow waters. However, the tunnel as described by Losev requires precise and particular manufacturing processes to form a boat bottom with such an inclined longitudinal tunnel. This results in added cost and complexity to the manufacturing process. Further, the longitudinal inflatable tubes are deformable and therefore do not provide a rigid bottom for the inflatable boat. This results in less stability in the inflatable boat and a reduction in power transfer from any attached motor. Accordingly, a more stable inflatable boat that is simpler and more cost-effective to manufacture is desirable.

SUMMARY

The above shortcomings may be addressed by providing, in accordance with one aspect of the invention, an inflatable boat for use with a motor. An inflatable boat for use with a motor having a jet intake or propeller, including: an inflatable body having a stern; a drop stitch inflatable bottom forming part of the inflatable body, the drop stitch inflatable bottom including one or more sections of high pressure drop stitch material and having a top side and bottom side; a cutout in the drop stitch inflatable bottom near the stern; and a cover covering the cutout and sealed to the top side of the drop stitch inflatable bottom; wherein the cutout and cover form a channel that facilitates a flow of water to the jet intake or propeller of the motor. The high pressure drop stitch material includes a multitude of fine threads provided in between the top side and the bottom side. The drop stitch inflatable bottom may be inflated to a pressure of 10-20 PSI. Preferably, the drop stitch inflatable bottom may be inflated to a pressure of 12-14 PSI.

In accordance with another aspect of the invention, the inflatable boat further includes one or more trim tabs hingedly attached to the drop stitch inflatable bottom near the stern.

The cutout and cover in the drop stitch inflatable bottom form a channel that facilitates a sufficient flow of water to the jet intake or propeller of an outboard motor that may be raised two or more inches higher than in conventional inflatable boats and consequently allows the inflatable boat of the present invention to operate in shallower waters. The drop stitch inflatable bottom further facilitates shallow water operations and improved power transfer by providing a completely flat and rigid bottom surface when inflated.

The foregoing summary is illustrative only and is not intended to be in any way limiting. Other aspects and features of the present invention will become apparent to those of ordinary skill in the art upon review of the following description of embodiments of the invention in conjunction with the accompanying figures and claims.

BRIEF DESCRIPTION OF THE DRAWINGS

Reference is now made to the accompanying drawings, in which.

DETAILED DESCRIPTION

Figure 1:
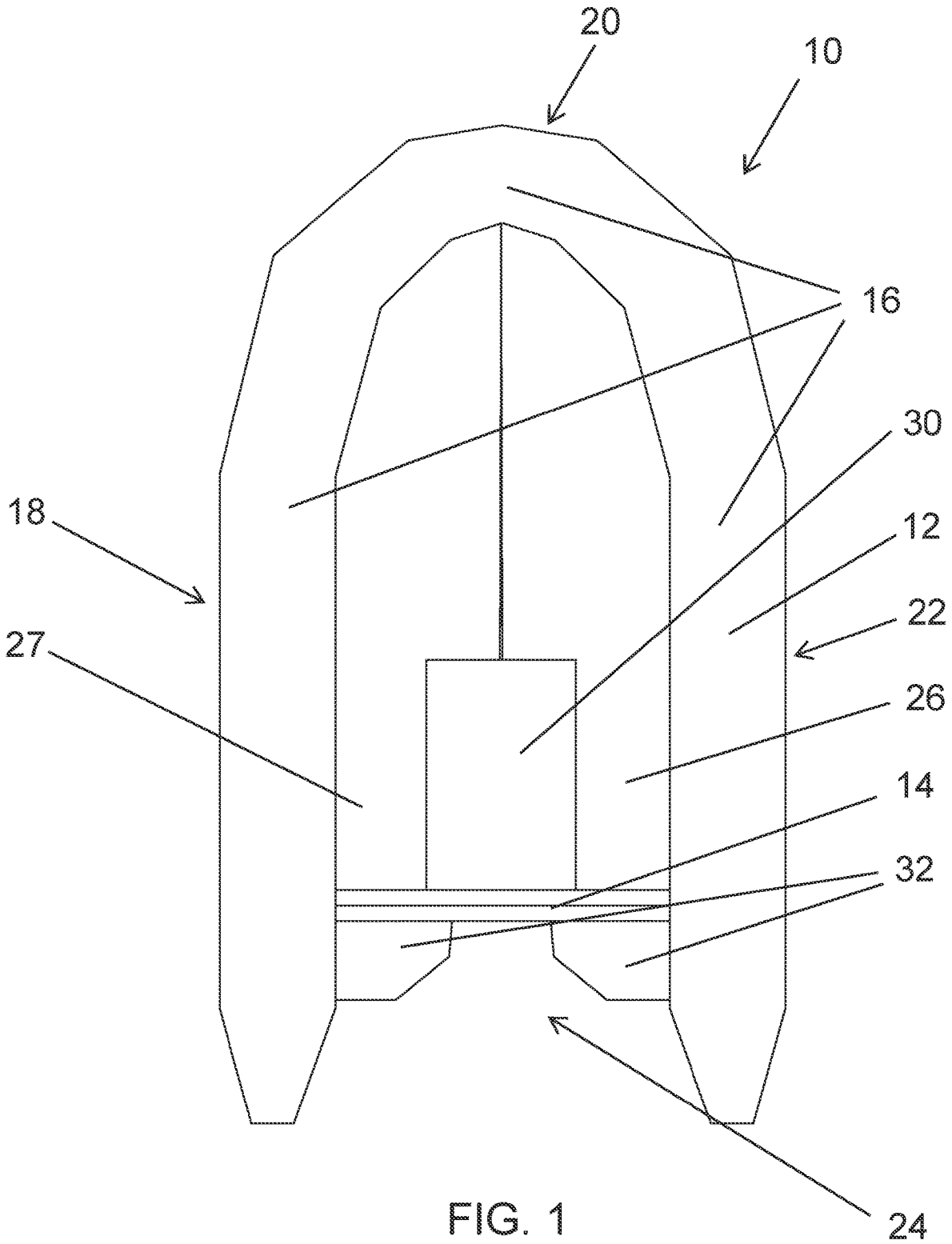
FIG. 1 is a top view of an inflatable boat according to an embodiment of the invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention as defined by the claims.

Referring to FIGS. 1 to 5, the inflatable boat according to an embodiment of the invention is shown generally at 10. Inflatable boat 10 is designed for use with any commercially available outboard motor suitable for inflatable boats (not shown). Inflatable boat 10 includes an inflatable body 12 and a transom 14. Inflatable body 12 includes: an arc-like periphery 16 that forms the port side 18, bow 20, and starboard side 22 of inflatable boat 10; an open stern 24; and a drop stitch inflatable bottom 26.

Referring to FIG. 1, arc-like periphery 16 is a single, continuous inflatable tube molded into an arc-like shape that forms port side 18, bow 20 and starboard side 22 of inflatable boat 10. Arc-like periphery 16 may be made of a polyvinyl chloride material, a polyester fabric, or any other suitable material. Alternatively, arc-like periphery 16 may also be made of a number of contiguous inflatable tube portions adjoined together to form an arc-like shape.

Figure 2:
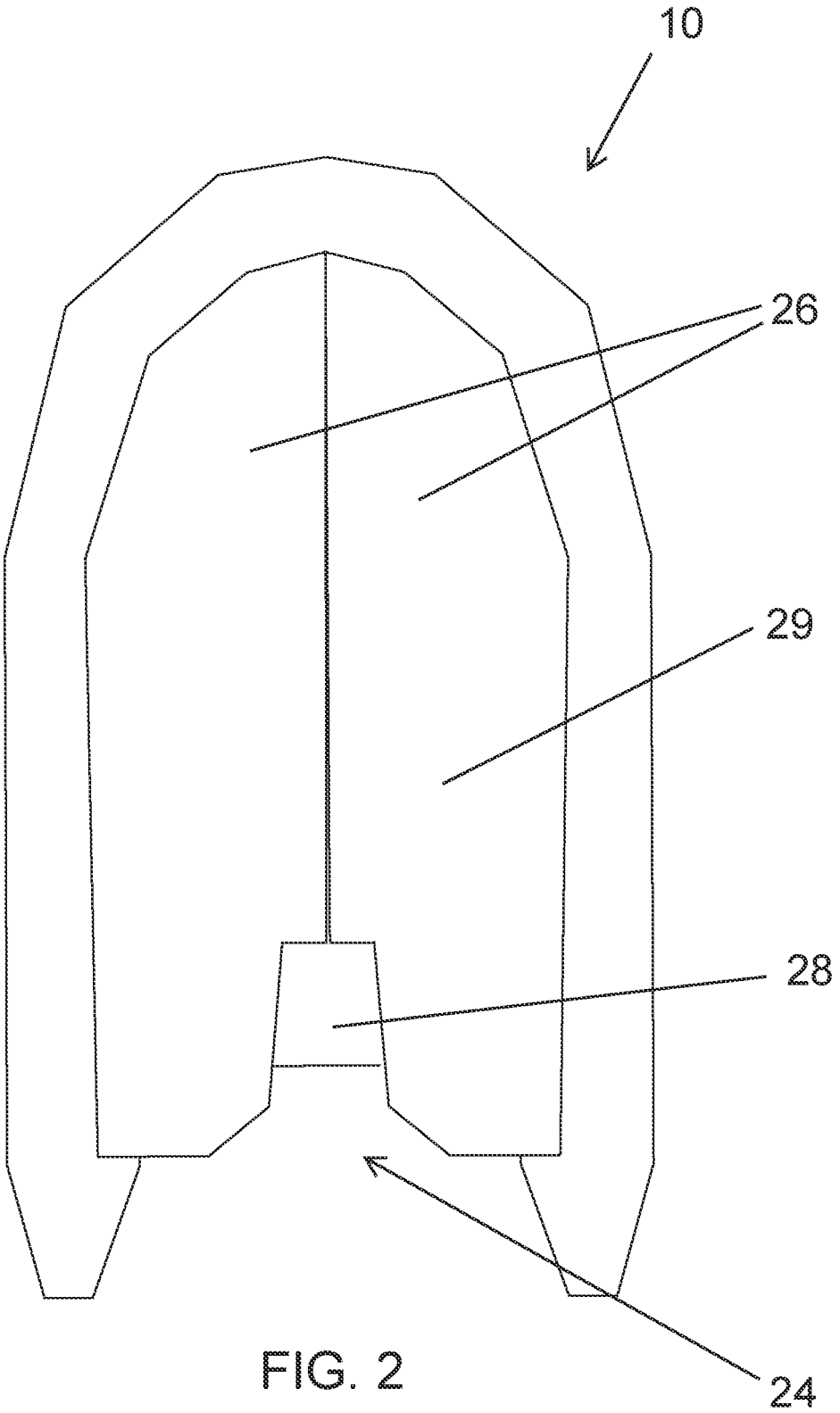
FIG. 2 is a bottom view of the inflatable boat of FIG. 1.
Figure 3A:
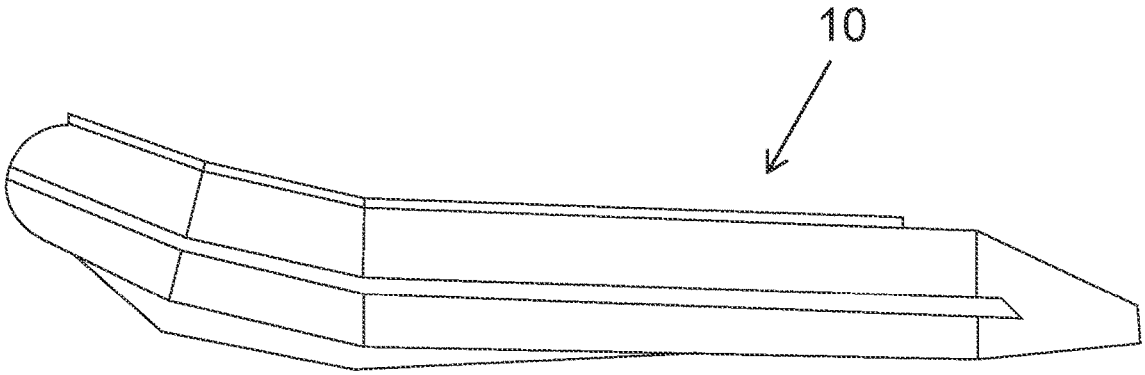
FIG. 3A is a side view of the inflatable boat of FIG. 1.
Figure 3B:
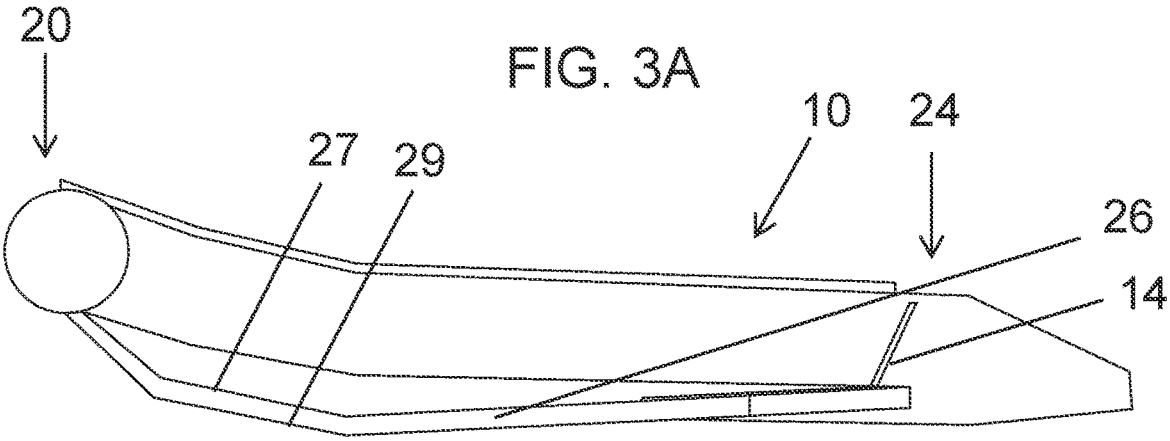
FIG. 3B is a cross-sectional view of the inflatable boat of FIG. 3A.
Figure 3C:
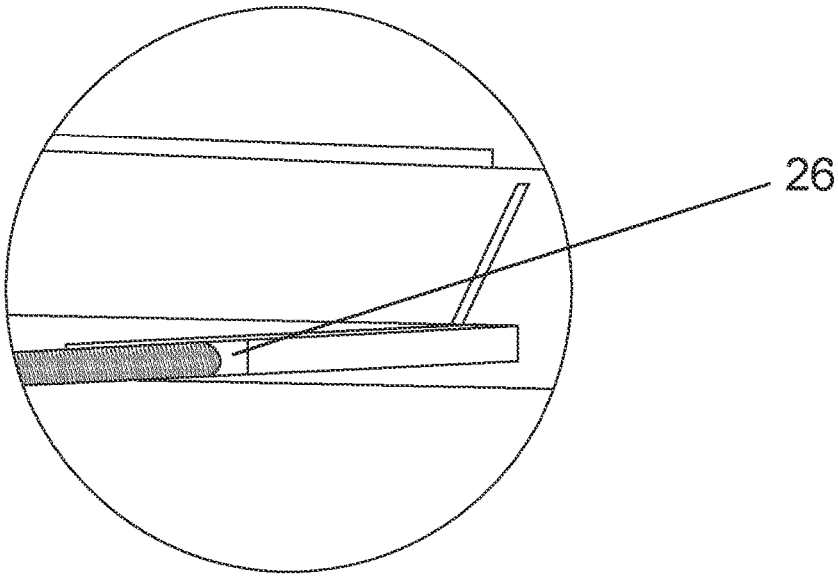
FIG. 3C is a close-up view of a section of the inflatable boat of FIG. 3B showing the drop stitch material of the drop stitch inflatable bottom.
Figure 4A:
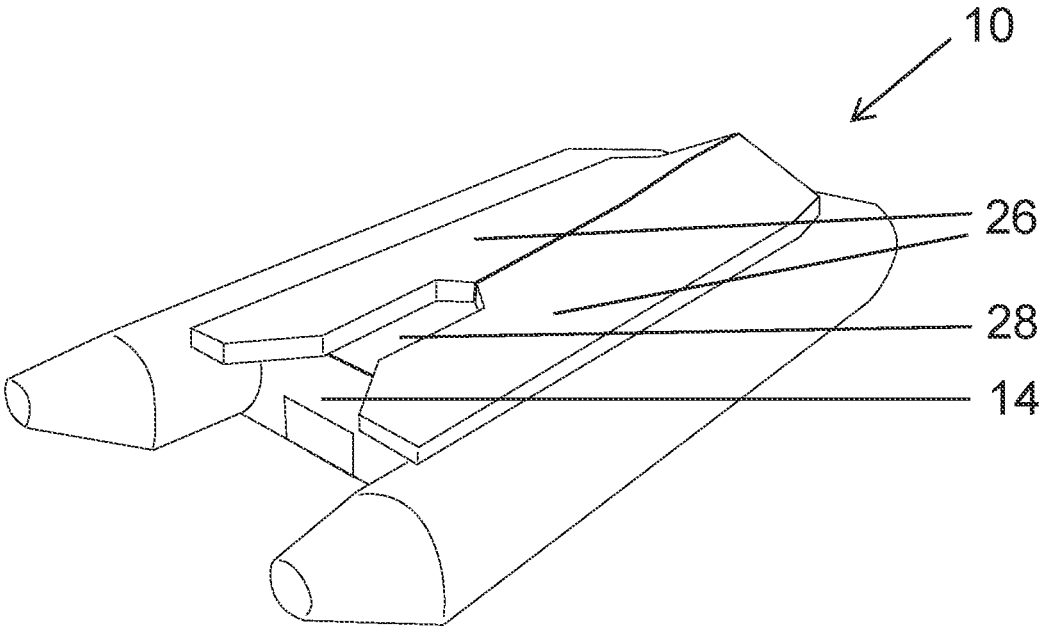
FIG. 4A is a perspective bottom view of the inflatable boat of FIG. 1.
Figure 4B:
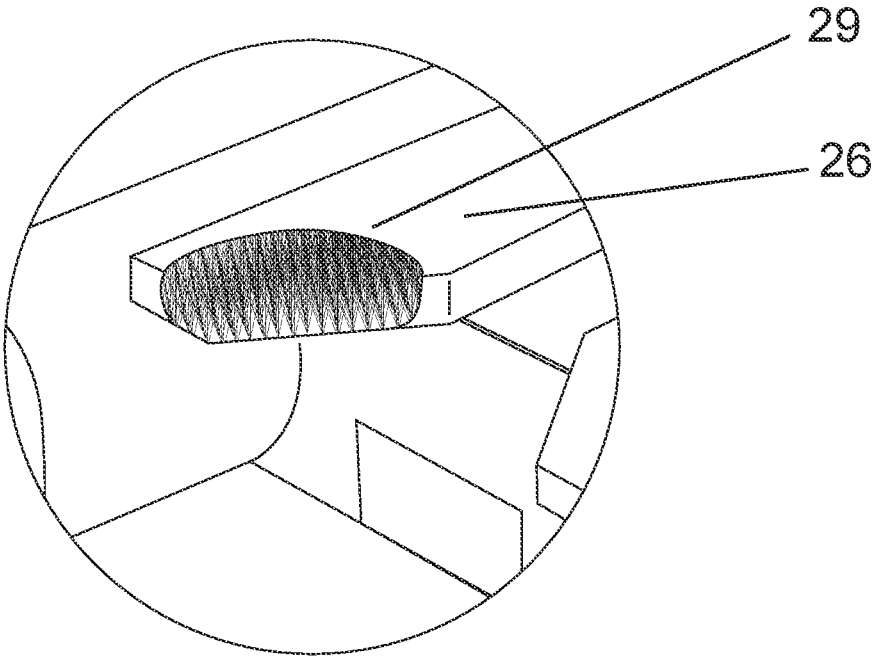
FIG. 4B is a close-up, cut-out view of a section of the inflatable boat of FIG. 4A showing the drop stitch material of the drop stitch inflatable bottom.
Figure 5:
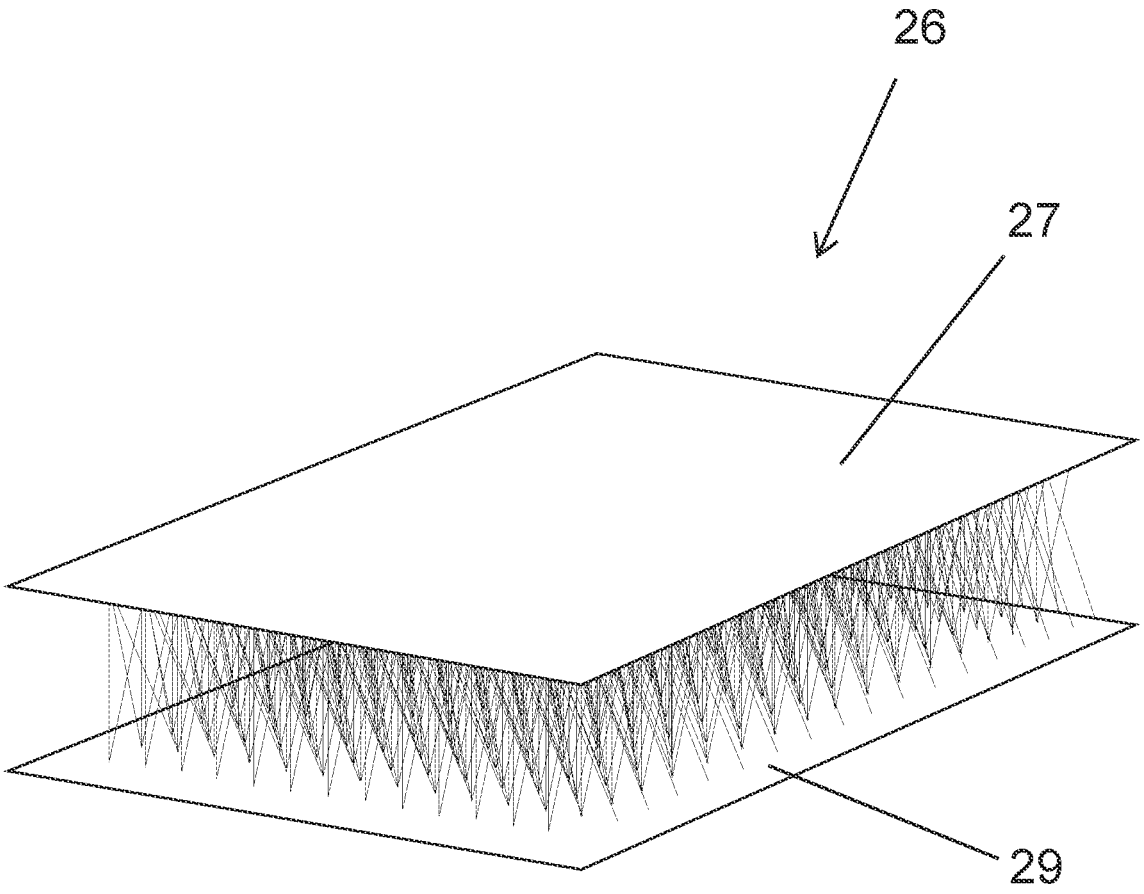
FIG. 5 is a cross sectional view of a section the drop stitch inflatable bottom of the inflatable boat of FIG. 1 showing the drop stitch material.

Referring to FIGS. 1 and 2, drop stitch inflatable bottom 26 is glued or welded directly to arc-like periphery 16. Drop stitch inflatable bottom 26 is made of two or more sections of high pressure drop stitch material. Each section is its own separate air compartment such that no air flow passes between each section. The number of sections of high pressure drop stitch material used to construct drop stitch inflatable bottom 26 may be adapted as needed for the intended use of inflatable boat 10. For example, two or more sections of high pressure drop stitch material may be used to shape drop stitch inflatable bottom 26 into a v-shape or other arced or curved shape as may be desired, which may provide better handling and performance in certain situations. Alternatively, drop stitch inflatable bottom 26 may be made of a single unitary section of high pressure drop stitch material (not shown). Use of a single unitary section of high pressure drop stitch material provides a flat drop stitch inflatable bottom 26, which provides better handling and performance in shallow water situations. An example of the drop stitch material used is shown in FIGS. 4B and 5, where a multitude of fine threads (drop stitches) are provided in between the top side 27 and bottom side 29 of inflatable bottom 26 to maintain an equal distance between the top side 27 and bottom side 29. The fine threads may be made of fine polyester threads that are tightly woven together or any other suitable material. Top side 27 and bottom side 29 may be made of a polyvinyl chloride material or any other suitable material. The drop stitch threads may be in a linear, a zigzag or other patterns such as "X" and "Y" patterns. The use of a drop stitch material allows inflatable bottom 26 to be inflated to a higher pressure than other conventional inflatable bottoms, such that inflatable bottom 26 forms a rigid and sturdy surface. By way of example, drop stitch inflatable bottom 26 may be inflated to a pressure of 10-20 PSI. Preferably, drop stitch inflatable bottom 26 may be inflated to a pressure of 12-14 PSI. Once fully inflated, drop stitch inflatable bottom 26 is approximately four inches thick. However, the thickness of drop stitch inflatable bottom 26 may be varied as per desired functionality. The rigid and sturdy surface formed by drop stitch inflatable bottom 26 allows for greater energy transfer from the outboard motor (not shown) to inflatable boat 10 and allows inflatable boat 10 to perform better on plane as there are less or no crevices that could cause performance issues in conventional inflatable bottom boats. The drop stitch material also allows inflatable bottom 26 to have completely flat top and bottom surfaces when inflated, further facilitating use of inflatable boat 10 in shallower waters.

Referring to FIG. 2, drop stitch inflatable bottom 26 includes a cutout 28 near stern 24 of inflatable boat 10. Cutout 28 is an aperture sized and shaped to direct a flow of water to the jet intake or propeller of a conventional outboard motor suitable for inflatable boats (not shown). As shown in FIG. 2, cutout 28 is in the shape of a trapezoid. However, it will be understood by a person skilled in the art that cutout 28 may be in any other suitable shape. Referring to FIG. 1, cutout 28 includes a cover 30. Cover 30 is in the shape of a rectangle and has an area that is larger than that of cutout 28. Cover 30 may be of a different size and shape from that of cutout 28 to ensure there is sufficient coverage of cutout 28. Cover 30 is located on top side 27 of drop stitch inflatable bottom 26 and is glued or welded to drop stitch inflatable bottom 26 to create a watertight seal and consequently, a watertight drop stitch inflatable bottom 26. Cover 30 may be made of a polyvinyl chloride material, a polyester fabric, a drop stitch material or any other suitable material. Cover 30 may also be reinforced with a rigid insert (not shown) such as a suitably shaped wooden panel, metal panel, or other panel made of suitable materials. The rigid insert (not shown) may assist with preventing bunching of any softer material that may be used to form cover 30. Cutout 28 in drop stitch inflatable bottom 26 allows an outboard motor (not shown) to be mounted to inflatable boat 10 in a position that allows the jet intake or propeller of an outboard motor (not shown) to be raised by approximately two inches or more higher than in a conventional inflatable boat, which assists inflatable boat 10 to operate in shallower waters. A jet intake or propeller of an outboard motor requires a sufficient flow of water to pass through it in order to provide the desired amount of propulsive force to an inflatable boat. Thus, a jet intake or propeller of an outboard motor is often set lower on the boat for it to be sufficiently submerged into a body of water and to allow it to draw a sufficient flow of water to function as desired. Consequently, the jet intake or propeller of an outboard motor is set relatively low in conventional inflatable boats, which can cause problems when operating in shallower waters. Cutout 28 of inflatable boat 10 permits an outboard motor (not shown) to be mounted to inflatable boat 10 in a higher position than in conventional inflatable boat set ups because cutout 28 creates a channel that facilitates a sufficient flow of water to the intake or propeller that is raised higher relative to conventional set ups.

Referring to FIG. 1, port side 18 and starboard side 22 of arc-like periphery 16 extends beyond drop stitch inflatable bottom 26 near stern 24 such that the length of port side 18 and starboard side 22, as measured from bow 20 to stern 24, is greater than the length of drop stitch inflatable bottom 26, as measured from bow 20 to stern 24. Thus, the extreme points of port side 18 and starboard side 22 are located at a larger distance from bow 20 than the extreme point of drop stitch inflatable bottom 26 near stern 24. However, it will be understood by a person skilled in the art that the lengths of arc-like periphery 16 on port side 18 and starboard side 22 may be adjusted as desired, which in some cases may mean that arc-like periphery 16 on port side 18 and starboard side 22 are equidistant from bow 20 with drop stitch inflatable bottom 26.

Referring to FIGS. 1 and 2, transom 14 is a beam connected to port side 18 and starboard side 22 of arc-like periphery 16 near stern 24. Preferably, transom 14 is positioned near the edge of cutout 28 that is furthest away from bow 20. Transom 14 may be made of aluminum, marine plywood, composite materials, or any other suitable materials. An outboard motor (not shown) may be mounted to transom 14.

Optionally, drop stitch inflatable bottom 26 may include trim tabs 32. At stern 24, trim tabs 32 are the portions of drop stitch inflatable bottom 26 that extend beyond transom 14 from bow 20 to stern 24. Trim tabs 32 provide several advantages, including improving handling, increasing speed, and increasing fuel efficiency of inflatable boat 10. Trim tabs 32 may also better direct the water to the jet pump or propeller of an outboard motor (not shown).

Figure 6A:
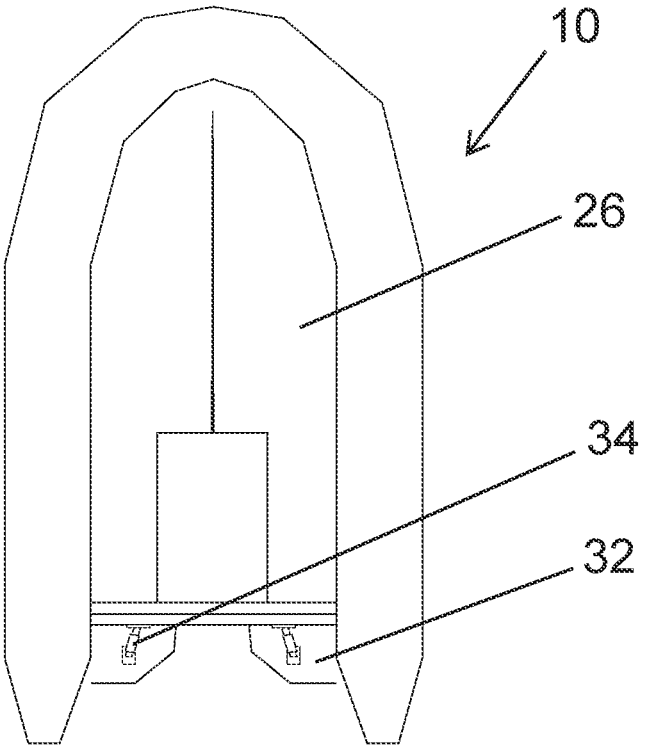
FIG. 6A is a top view of an inflatable boat according to another embodiment of the present invention.
Figure 6B:
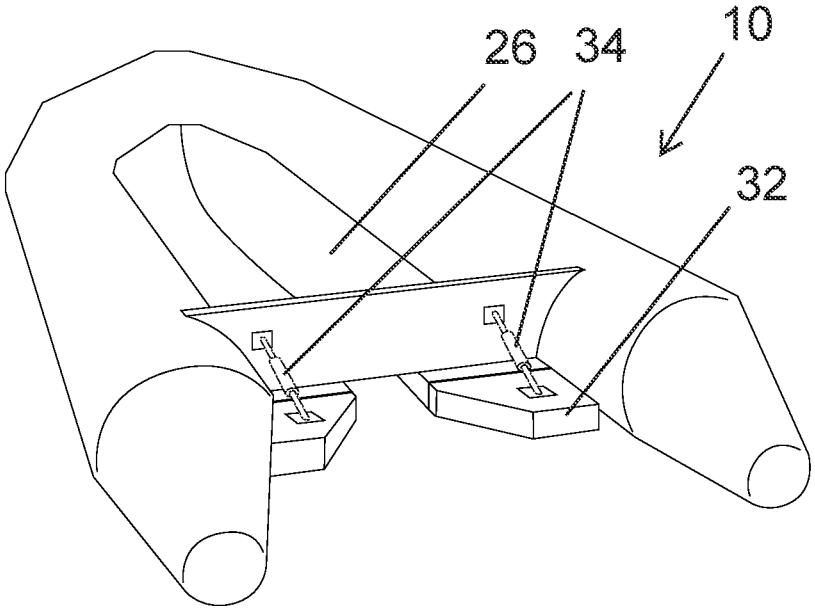
FIG. 6B is a perspective back view of the inflatable boat of FIG. 6A.

Referring to FIGS. 6A and 6B, another embodiment of the present invention is shown. In this embodiment, trim tabs 32 are hingedly attached to drop stitch inflatable bottom 26. Trim tabs 32 may be hingedly attached to drop stitch inflatable bottom 26 with a thin piece of flexible material welded on to trim tabs 32 and drop stitch inflatable bottom 26, a hinge, an actuator 34, or with any other suitable mechanism known to the art.

It is to be understood by a person skilled in the art that inflatable boat 10 may also be adapted to be used with small inboard jet propulsion engines, such as for example, those found on jet skis or personal watercraft (for example SEA-DOO™), in which case the intake for the jet propulsion engine is situated within cutout 28.

While embodiments of the invention have been described and illustrated, such embodiments should be considered illustrative of the invention only. The invention may include variants not described or illustrated herein in detail. Thus, the embodiments described and illustrated herein should not be considered to limit the invention as construed in accordance with the accompanying claims.

What is claimed is:

1. An inflatable boat for use with a motor having a jet intake or propeller, comprising:

an inflatable body having a stern;

a transom connected to the inflatable body proximate the stern for mounting the motor;

a drop stitch inflatable bottom forming part of the inflatable body, the drop stitch inflatable bottom comprising one or more sections of drop stitch material and having a top side and bottom side;

a cutout defined in the drop stitch inflatable bottom near the stern, the cutout being fore of the transom;

a cover covering the cutout and sealed to the top side of the drop stitch inflatable bottom, wherein the cutout and cover form a channel that facilitates a flow of water to the jet intake or propeller of the motor; and one or more trim tabs hingedly attached to the drop stitch inflatable bottom near the stern and aft of the transom.

2. The inflatable boat of claim 1, wherein the drop stitch material comprises a multitude of fine threads provided in between the top side and the bottom side.

3. The inflatable boat of claim 1, wherein the drop stitch inflatable bottom may be inflated to a pressure of 10-20 PSI.

4. The inflatable boat of claim 3, wherein the drop stitch inflatable bottom may be inflated to a pressure of 12-14 PSI.

* * * * *